US010302098B2

(12) United States Patent
Li et al.

(10) Patent No.: US 10,302,098 B2
(45) Date of Patent: May 28, 2019

(54) HEATING PUMP

(71) Applicant: JOHNSON ELECTRIC INTERNATIONAL AG, Murten (CH)

(72) Inventors: Min Li, Shenzhen (CN); Jin Jin Wu, Shenzhen (CN); Kok Ang Chong, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 618 days.

(21) Appl. No.: 14/820,075

(22) Filed: Aug. 6, 2015

(65) Prior Publication Data

US 2016/0040686 A1 Feb. 11, 2016

(30) Foreign Application Priority Data

Aug. 7, 2014 (CN) ..... 2014 1 0387136

(51) Int. Cl.

| | |
|---|---|
| ***F01D 25/10*** | (2006.01) |
| ***F04D 29/58*** | (2006.01) |
| ***F04D 1/00*** | (2006.01) |
| ***F04D 13/06*** | (2006.01) |
| ***F04D 29/22*** | (2006.01) |
| ***F04D 29/42*** | (2006.01) |

(52) U.S. Cl.

CPC ..... *F04D 29/5893* (2013.01); *F04D 1/00* (2013.01); *F04D 13/06* (2013.01); *F04D 29/22* (2013.01); *F04D 29/426* (2013.01); *F04D 29/588* (2013.01)

(58) Field of Classification Search

CPC ..... A47L 15/4285; A47L 15/4225

See application file for complete search history.

(56) References Cited

U.S. PATENT DOCUMENTS 6,144,020 A 11/2000 Usui et al.
6,736,598 B2 * 5/2004 Kleemann ..... A47L 15/4225 219/543

(Continued)

FOREIGN PATENT DOCUMENTS

DE 3640252 A1 6/1988
DE 19903951 A1 * 8/2000 ..... A47L 15/4225

(Continued)

OTHER PUBLICATIONS

Helmet, Ohnmacht; DE19903951—translation (machine english translation).*

*Primary Examiner* — Woody A Lee, Jr.
*Assistant Examiner* — Jason A Fountain
(74) *Attorney, Agent, or Firm* — Muncy, Geisler, Olds & Lowe, P.C.

(57) ABSTRACT

A heating pump includes a pump housing with an inlet, an outlet, a heater, an impeller, and a motor for driving the impeller. The impeller is received in the pump housing. The heater includes connecting heads and a main body for generating heat. The main body is bent into an arc. The pump housing includes a cylindrical sidewall extending in an axial direction of the motor and a top plate sealed to an axial opening of the sidewall. The top plate is made of metal. The heater extends through and is fixed to the top plate. The connecting heads extend to an exterior of the pump housing. The main body is located in an interior of the pump housing and in contact with the top plate.

8 Claims, 2 Drawing Sheets

(56) References Cited

U.S. PATENT DOCUMENTS

| | | | | |
|---|---|---|---|---|
| 7,287,536 | B2 * | 10/2007 | Steck | A47L 15/4225 134/107 |
| 7,965,928 | B2 * | 6/2011 | Eichholz | D06F 39/04 392/417 |
| 8,245,718 | B2 * | 8/2012 | Busing | A47L 15/4225 134/108 |
| 9,145,901 | B2 * | 9/2015 | Li | F04D 29/588 |
| 2004/0173249 | A1 | 9/2004 | Assmann et al. | |
| 2004/0211771 | A1 * | 10/2004 | Crandell | H05B 3/44 219/544 |
| 2008/0044168 | A1 | 2/2008 | Eichholz et al. | |
| 2011/0052420 | A1 * | 3/2011 | Hagleitner | F04D 15/0066 417/53 |
| 2012/0263581 | A1 | 10/2012 | Li et al. | |
| 2013/0108252 | A1 | 5/2013 | Liu et al. | |
| 2013/0230416 | A1 | 9/2013 | Verma et al. | |
| 2015/0157185 | A1 | 6/2015 | Welch | |
| 2015/0337859 | A1 | 11/2015 | Qi et al. | |

FOREIGN PATENT DOCUMENTS

| | | | |
|---|---|---|---|
| DE | 10142525 | A1 | 3/2003 |
| EP | 1047334 | A1 | 11/2000 |
| EP | 1224902 | A2 | 7/2002 |
| EP | 1247993 | A2 | 10/2002 |
| GB | 2310360 | A | 8/1997 |
| WO | WO2015/161685 | A1 | 10/2015 |
| WO | WO2016/008286 | A1 | 1/2016 |

* cited by examiner

HEATING PUMP

CROSS REFERENCE TO RELATED APPLICATIONS

This non-provisional patent application claims priority under 35 U.S.C. § 119(a) from Patent Application No. 201410387136.2 filed in The People's Republic of China on Aug. 7, 2014, the entire contents of which are hereby incorporated by reference.

FIELD OF THE INVENTION

This invention relates to heating pumps and in particular, to a heating pump which employs a metal plate to increase the contact area between the heater and the fluid.

BACKGROUND OF THE INVENTION

Heating pumps typically include a pump housing having a chamber, a heater fixed to the pump housing and received in the chamber, an impeller received in the pump housing, and a motor fixed to the pump housing for driving the impeller. The entire pump housing of one typical heating pump is made of plastic, which includes a top plate facing the motor and an inlet tube extending from an exterior of the top plate to an interior of the chamber. The heater includes two connecting heads and a spiral main body having multiple rings. The two connecting heads extend through and are locked to the top plate. The main body surrounds part of the inlet tube located in the chamber. During operation, the water enters the impeller via the inlet tube. The water is then expelled from the pump chamber via an outlet by the impeller. The water is heated as it flows through the main body of the heater on its way to the outlet. In this design, the main body of the heater is in the form of multiple rings, which obstructs the flow of the water and hence leads to low pump efficiency.

SUMMARY OF THE INVENTION

Hence, there is a desire for a heat pump with an enhanced efficiency.

Accordingly, in one aspect thereof, the present invention provides a heating pump comprising: a pump housing having an inlet, an outlet, a cylindrical sidewall, and a top plate sealingly fixed to an axial opening of the sidewall, the top plate is made of metal; a heater fixed to the pump housing, the heater comprises connecting heads and a main body connected between the connecting heads; an impeller received in the pump housing; and a motor fixed to the pump housing for rotating the impeller, wherein the heater extends through and is fixed to the top plate, the connecting heads extend to an exterior of the pump housing, and the main body of the heater is formed as an arc, is located in an interior of the pump housing and is in contact with the top plate.

Preferably, a cross section of the main body is in the shape of a chamfered rectangle and has four outer surfaces, and one of the outer surfaces is in intimate contact with the top plate.

Preferably, the main body is soldered to the top plate.

Preferably, the top plate defines a first hole, the inlet comprises a fixing tube and a connecting tube, and a first interlock structure is formed between a peripheral area of the first hole of the top plate and one end of the connecting tube to fix the connecting tube to the top plate.

Preferably, a second interlock structure is formed between an outer radial surface of the fixing tube within the connecting tube and an inner radial surface of the connecting tube contacting the fixing tube.

Preferably, the top plate comprises a hollow block raised in a direction away from the motor, second holes are defined at a side of the block remote from the motor, the connecting heads are bent from the main body and extend in a direction perpendicular to a plane in which the main body is located, the connecting heads extend through the second holes to the exterior of the pump housing, and bending sections of the connecting heads are received in the block.

Preferably, the pump body further includes a partition plate disposed at an opening of the top plate that is formed as a result of forming the block.

Preferably, the pump body further comprises an outer cover mounted to a side of the top plate remote from the motor.

Preferably, the motor is a high voltage direct current motor.

In the heating pump described above, the contact area between the main body and the fluid is significantly increased. Because only one ring of the heater is presented, the resistance to the flow is reduced. In addition, the intimate contact between the metal top plate and the heater enhances the heating efficiency of the single-ring heater.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
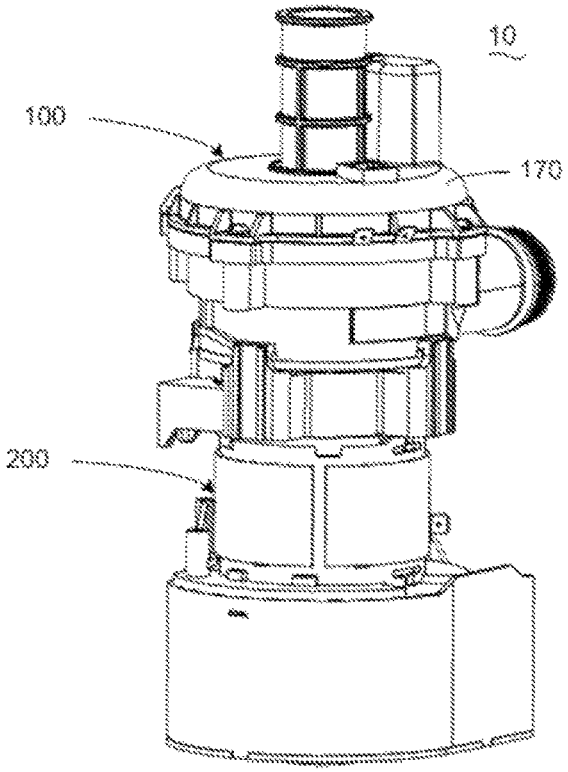
FIG. 1 illustrates a heating pump according to one embodiment.

FIG. 1 illustrates a heating pump 10 in accordance with one embodiment of the present invention. The pump includes a pump body 100 and a motor 200. Working fluid is drawing into and expelled from the pump by a rotating impeller. During passage through the pump the fluid is heated by a heater disposed within the pump body.

Figure 2:
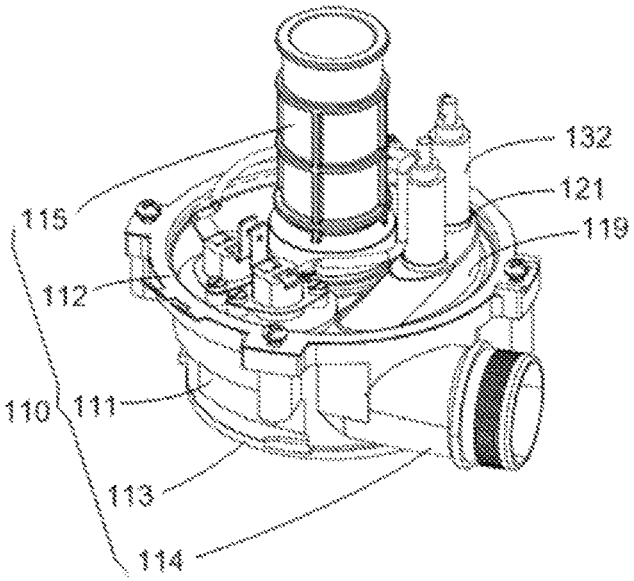
FIG. 2 illustrates a pump body, being a part of the pump of FIG. 1, with some parts removed.
Figure 3:
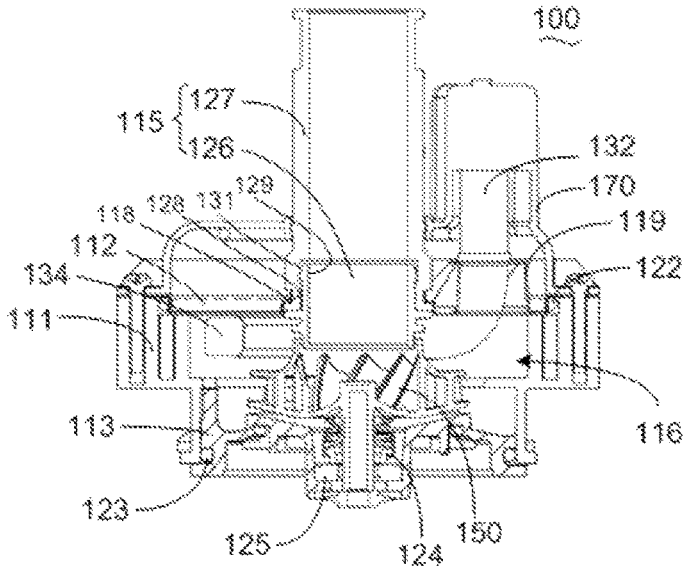
FIG. 3 is a sectional view of the pump body of FIG. 2.
Figure 4:
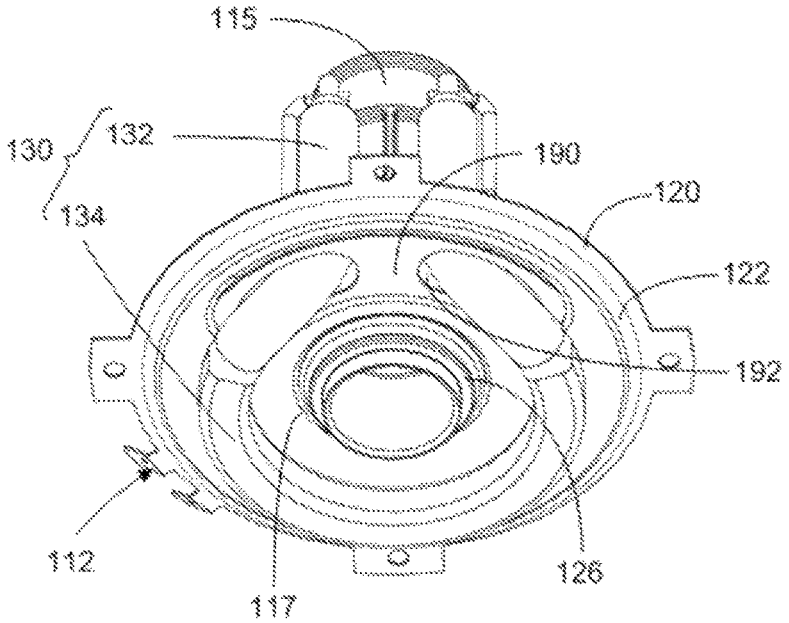
FIG. 4 illustrates a part of the pump body of FIG. 2.

FIGS. 2 through 4, illustrate parts of the pump body 100. The pump body 100 includes a pump housing 110, a heater 130 fixed to the pump housing 110, an impeller 150 received in the pump housing 110, and an outer cover 170. The pump housing 110 includes a generally cylindrical sidewall 111, a top plate 112 sealingly fixed to an axial opening of the sidewall 111, a bottom plate 113 sealingly fixed to the other axial opening of the sidewall 111, an outlet 114 in the form of a tube extending tangentially from the sidewall 111, and an inlet 115 axially extending through the top plate 112. The sidewall 111, top plate 112 and bottom plate 113 cooperatively define a chamber 116 there between. The outlet 114 and inlet 115 communicate the chamber 116 with an exterior space of the pump housing 110.

The top plate 112 is made of a metal material and is generally of a round shape. The top plate 112 includes a centrally defined first hole 117, a projecting ring 118 extending radially outwardly from a peripheral area around the first hole 117, a hollow raised block 119 disposed at one side of the first hole 117, and an outer flange 120 formed at an outer edge of the top plate 112. The block 119 may be formed by stamping the top plate 112. As shown in FIGS. 3 and 4, the block 119 is raised from the top plate 112, with two second holes 121 defined in a top of the block 119. A sealing ring 122 is attached to the outer flange 120. The top plate 112 is mounted to the sidewall 111 with screws, with the sealing ring 122 intimately sandwiched between the sidewall 111 and the top plate 112 to seal the top plate to the side wall. The bottom plate 113 is sealingly mounted to the other axial opening of the sidewall 111 through a sealing ring 123. A fixing slot 125 is formed at a center of the bottom plate 113 for receiving a sealing assembly 124.

The inlet 115 includes a fixing tube 126 and a connecting tube 127. An outer surface of one end of the connecting tube 127 defines an annular groove 128 matching with the projecting ring 118. The connecting tube 127 may be formed from a soft material such as plastic, such that the connecting tube 127 deforms at the annular groove 128 before the annular groove 128 engagingly receives the projecting ring 118. The fixing tube 126 extends through the first hole and is inserted into the connecting tube 127, in a tight fit manner, with a radially outer side of the fixing tube 126 contacting with a radially inner side of the connecting tube 127, such that the projecting ring 118 and the annular groove 128, once locked together, are prevented from easily becoming disengaged from each other, thus fixing the connecting tube 127 with the top plate 112. The fixing tube 126 may be made from a hard material such as a plastic material. The fixing tube 126 and the connecting tube 127 may be frictionally fixed to each other. Alternatively, interlocking structures may be disposed between the contacting surfaces of the fixing tube 126 and the connecting tube 127 to lock them to each other. For example, as shown in FIG. 3, a barb 129 is formed on an outer side of the fixing tube 126, and an annular locking groove 131 is formed in an inner side of the connecting tube 127 for receiving the barb 129.

The heater 130 includes connecting heads 132 and a heat generating main body 134 connected between the connecting heads 132. The main body 134 is made of a material having a higher electrical resistivity than the connecting heads 132. The main body 134 is formed into an arc close to a circle. The connecting heads 132 extend from ends of the main body and bend to be substantially in parallel in a direction perpendicular to a plane in which the main body 134 is located. The connecting heads 132 extend through the second holes 121 of the block 119, with bending sections of the connecting heads received in the block 119, such that the main body 134 is in intimate contact with the top plate 112 to ensure good heat transfer there between. The main body 134 can be fixed to the top plate by any suitable means, such as by soldering. Preferably, a cross section of the main body 134, perpendicular to an extending direction of the main body 134, is in the shape of a chamfered rectangle and includes four outer surfaces, with one of the outer surfaces soldered to the top plate 112. The bending sections usually cannot be bent sharply, but rather usually have smooth transition portions. Therefore, the block 119 can receive portions of the bending sections raised toward the connecting heads, which allows for the intimate contact between the main body 134 and the top plate 112.

The impeller 150 is mounted to the bottom plate 113 through the sealing assembly 124 and is received in the chamber 116 for rotation about an axis of the motor, relative to the bottom plate 113. One end of the fixing tube 126 remote from the connecting tube 127 is partially inserted into an inlet of the impeller 150. The motor 200 is fixed to the pump body 100 and has a shaft fixedly connected to the impeller 150 for driving the impeller 150. The outer cover 170 is mounted to one side of the top plate 112 remote from the pump housing 110 and covers the top plate 112 and the connecting heads 132 of the heater 130, with only a necessary power port for supplying power to the heater 130 exposed. The connecting tube 127 also extends through the outer cover 170. The outer cover 170 protects the connecting heads 132 and the top plate 112 and prevents the hot top plate 112 from hurting people as well. As such, parts of the pump body 100 are assembled into a module which is in turn assembled with the motor to form the entire heating pump 10.

During operation, the fluid, such as water, is drawn into the impeller 150 via the inlet 115 and expelled from the pump via the outlet 114 by rotation of the impeller 150. During the course of flowing to the outlet 114, the fluid contacts and is hence heated by the heater 130 and the top plate 112. Because the main body 134 is in intimate contact with the top plate 112, the heat of the main body 134 can be timely transferred to the top plate 112. As such, the contact area between the main body 134 and the fluid is significantly increased. Because the heater 130 has only one ring, the resistance to the flow of fluid is reduced. In addition, the intimate contact between the metal top plate 112 and the heater 130 enhances the heating efficiency of the single heater 130.

In the embodiment above, the projecting ring 118 and the annular groove 128 form an interlock structure there between to fix the connecting tube 127 and the top plate 112 to each other. In another embodiment, the projecting ring is formed on the connecting tube, and the annular groove is formed in the fixing tube. In still another embodiment, the projecting ring and the annular groove may not be continuous structures along the circumferences of the connecting tube and first hole; rather, they may be configured as discontinuous projection and groove structures. Therefore, any suitable interlock structure can be formed between the peripheral area of the first hole 117 of the top plate and one end of the connecting tube 127. Similarly, any suitable interlocking structure can be formed between the outer radial surface of the fixing tube 126 within the connecting tube 127 and the inner radial surface of the connecting tube 127 contacting the fixing tube 126.

Preferably, the pump body 100 further includes a partition plate 190 disposed at an opening of the top plate 112 that is formed as result of the raising of the block 119. Disposing the partition plate 190 at the opening can prevent the opening from advertently affecting of the flow of the fluid, thus enhancing the pump efficiency. The partition plate defines third holes 192 for the connecting heads 132 of the heater 130 to extend there through. In addition, preferably, the block 119 may not be required to be formed on the top plate 112. Rather, the partition plate 190 may be a structure integrally formed with the entire top plate 112. Preferably, the motor 200 is a high voltage direct current motor. By high voltage we mean that the motor can operate on rectified electrical mains voltage power without voltage modification.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A heating pump comprising:

a pump housing having an inlet, an outlet, a cylindrical sidewall, and a top plate sealingly fixed to an axial opening of the sidewall, the top plate is made of metal;

a heater fixed to the pump housing, the heater comprises connecting heads and a main body connected between the connecting heads;

an impeller received in the pump housing; and a motor fixed to the pump housing for rotating the impeller, wherein the heater extends through and is fixed to the top plate, the connecting heads extend to an exterior of the pump housing, and the main body of the heater is formed as an arc, is located in an interior of the pump housing and is in contact with the top plate, a cross section of the main body is in the shape of a chamfered rectangle and has four outer surfaces, and one of the outer surfaces is in intimate contact with the top plate, and wherein the main body is soldered to the top plate, and wherein the pump body further comprises an outer cover mounted to a side of the top plate remote from the motor.

2. The pump of claim 1, wherein the top plate defines a first hole, the inlet comprises a fixing tube and a connecting tube, and a first interlock structure is formed between a peripheral area of the first hole of the top plate and one end of the connecting tube to fix the connecting tube to the top plate.

3. The pump of claim 2, wherein a second interlock structure is formed between an outer radial surface of the fixing tube within the connecting tube and an inner radial surface of the connecting tube contacting the fixing tube.

4. The pump of claim 1, wherein the top plate comprises a hollow block raised in a direction away from the motor, second holes are defined at a side of the block remote from the motor, the connecting heads are bent from the main body and extend in a direction perpendicular to a plane in which the main body is located, the connecting heads extend through the second holes to the exterior of the pump housing, and bending sections of the connecting heads are received in the block.

5. The pump of claim 4, wherein the pump body further includes a partition plate disposed at an opening of the top plate that is formed as a result of forming the block.

6. The pump of claim 1, wherein the motor is a high voltage direct current motor.

7. A heating pump comprising:

a pump housing having an inlet, an outlet, a cylindrical sidewall, and a top plate sealingly fixed to an axial opening of the sidewall, the top plate is made of metal;

a heater fixed to the pump housing, the heater comprises connecting heads and a main body connected between the connecting heads;

an impeller received in the pump housing; and a motor fixed to the pump housing for rotating the impeller, wherein the heater extends through and is fixed to the top plate, the connecting heads extend to an exterior of the pump housing, and the main body of the heater is formed as an arc, is located in an interior of the pump housing and is in contact with the top plate, and wherein the top plate defines a first hole, the inlet comprises a fixing tube and a connecting tube, and a first interlock structure is formed between a peripheral area of the first hole of the top plate and one end of the connecting tube to fix the connecting tube to the top plate.

8. A heating pump comprising:

a pump housing having an inlet, an outlet, a cylindrical sidewall, and a top plate sealingly fixed to an axial opening of the sidewall, the top plate is made of metal;

a heater fixed to the pump housing, the heater comprises connecting heads and a main body connected between the connecting heads;

an impeller received in the pump housing; and a motor fixed to the pump housing for rotating the impeller, wherein the heater extends through and is fixed to the top plate, the connecting heads extend to an exterior of the pump housing, and the main body of the heater is formed as an arc, is located in an interior of the pump housing and is in contact with the top plate, and wherein the top plate comprises a hollow block raised in a direction away from the motor, second holes are defined at a side of the block remote from the motor, the connecting heads are bent from the main body and extend in a direction perpendicular to a plane in which the main body is located, the connecting heads extend through the second holes to the exterior of the pump housing, and bending sections of the connecting heads are received in the block.

* * * * *